US006666154B2

(12) United States Patent
Logan et al.

(10) Patent No.: US 6,666,154 B2
(45) Date of Patent: Dec. 23, 2003

(54) METHODS FOR CONTROLLING IGNITABILITY OF ORGANIC WASTE WITH MINERAL BY-PRODUCTS

(75) Inventors: Terry J. Logan, Columbus, OH (US); Ervin L. Faulmann, Toledo, OH (US)

(73) Assignee: N-Viro International Corporation, Toledo, OH (US)

( * ) Notice: Subject to any disclaimer, the term of this patent is extended or adjusted under 35 U.S.C. 154(b) by 0 days.

(21) Appl. No.: 10/120,537

(22) Filed: Apr. 12, 2002

(65) Prior Publication Data

US 2003/0192461 A1 Oct. 16, 2003

(51) Int. Cl.[7] ..... F23G 5/02; F23B 7/00
(52) U.S. Cl. ..... 110/346; 110/342
(58) Field of Search ..... 110/342, 346

(56) References Cited

U.S. PATENT DOCUMENTS 3,710,576 A * 1/1973 Evans et al. ..... 60/39.03
4,159,682 A * 7/1979 Fitch et al. ..... 110/245
4,274,255 A * 6/1981 Pollak ..... 60/39.14 R
4,554,002 A 11/1985 Nicholson ..... 71/12
4,787,323 A * 11/1988 Beer et al. ..... 110/346
4,970,803 A * 11/1990 Keller ..... 34/10
5,263,642 A * 11/1993 Orchard ..... 236/46 B
5,741,346 A 4/1998 Glover ..... 71/15
6,001,308 A * 12/1999 Marlow et al. ..... 422/94

FOREIGN PATENT DOCUMENTS

EP 0 303 339 2/1989
GB 2 295 146 5/1996
JP 407166843 A * 6/1995 ..... F01N/3/20

* cited by examiner

*Primary Examiner*—K. B. Rinehart
(74) *Attorney, Agent, or Firm*—Kenyon & Kenyon

(57) ABSTRACT

Methods and systems for treating organic waste, which include determining the ignition threshold temperature for the organic waste and at least one mineral by-product, selecting a ratio of organic waste:mineral by-product(s) based on the determined ignition threshold temperature, combining the mineral by-product(s) with the organic waste, so as to arrive at a mixture having the selected ratio of organic waste:mineral by-product(s); and drying the mixture of organic waste and mineral by-product(s) to produce organic waste solids. The treatment methods of the present invention are methods of stabilizing the treated organic waste so as to control the tendency of the organic waste to ignite. Also provided are organic waste solids formed by the methods of the present invention.

16 Claims, 2 Drawing Sheets

METHODS FOR CONTROLLING IGNITABILITY OF ORGANIC WASTE WITH MINERAL BY-PRODUCTS

FIELD OF THE INVENTION

The present invention relates to methods and systems for treating organic waste, which include determining the ignition threshold temperature for the organic waste and one or more mineral by-products, selecting a ratio of organic waste:mineral by-product based on the determined ignition threshold temperature, combining the mineral by-product(s) with the organic waste, so as to arrive at a mixture having the selected ratio of organic waste:mineral by-product(s); and drying the mixture of organic waste and mineral by-product (s) to produce organic waste solids.

The present invention also relates to organic waste solids formed by the methods of the present invention.

BACKGROUND OF THE INVENTION

Mineral by-products have been used in stabilizing semi-solid, odorous organic waste through bulk drying, odor absorption, and granulation (see e.g., U.S. Pat. Nos. 3,877,920 and 4,554,002). In addition, mineral materials including sand, diatomaceous earth, perlite, and various mineral reagent powders have been used in conjunction with fluidized heating, drying and burning of sludges and oily waste (see e.g., U.S. Pat. Nos. 4,159,682, 4,787,323, 4,970,803, 5,490,907). However, existing thermal dryers have ongoing problems with drying waste high in organics, particularly sewage sludges, in the waste sticking to dryer surfaces, charring and producing burnt organic matter odors, and catching on fire.

Therefore, a method of stabilizing organic waste without causing the ignition, sticking and/or production of burnt organic matter odors, caused by previously known methods, is desirable.

SUMMARY OF THE INVENTION

The present invention relates to methods and systems for treating organic waste. The present methods first require determining the ignition threshold temperature for the organic waste and one or more mineral by-products. The ignition threshold temperature is determined by plotting the ignition temperature of a mixture of a sample of the organic waste with a sample of the mineral by-products to be added to the organic waste. The plot indicates a threshold dose rate of mineral by-product to inhibit spontaneous ignition of the organic waste. Based on the ignition threshold temperature determined from the plot, a ratio of organic waste:mineral by-product(s) is selected for the actual (larger scale) process and the mineral by-product(s) is mixed with the organic waste so as to arrive at a mixture having the selected ratio of organic waste:mineral by-product(s). The mixture is then dried (or stored first and then dried) to arrive at organic waste solids, which are at least 60%, preferably at least 90%, more preferably at least 95% dried.

The treatment methods of the present invention are methods of stabilizing the treated organic waste so as to control the tendency of the organic waste to ignite for example, in external heat dryers.

The present invention is further directed to organic waste solids produced by the present methods, which are advantageous in not having a tendency to ignite.

DETAILED DESCRIPTION

Figure 1:
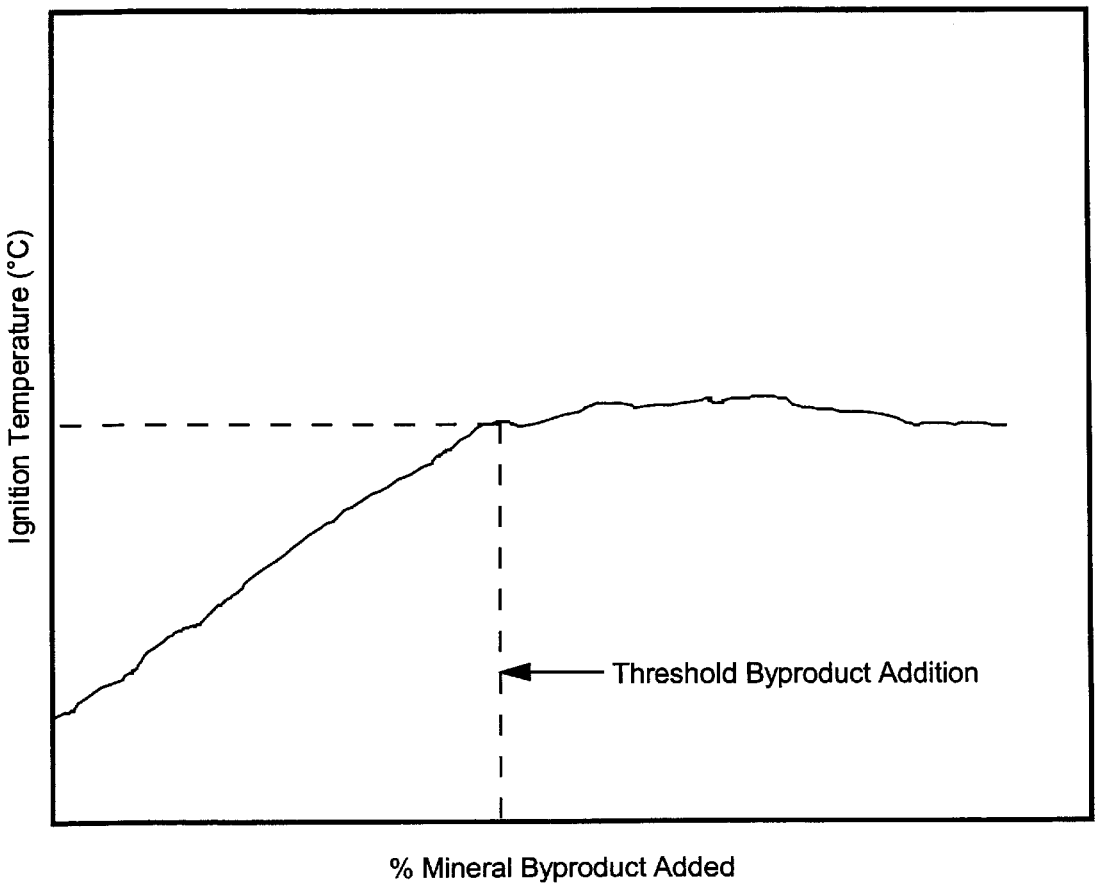
FIG. 1 is a theoretical plot of ignition temperature (° C.) of a mixture of an organic waste with a mineral by-product versus the dose rate of mineral by-product (% by weight of the organic waste on a wet weight basis) added to the mixture.

The present invention will now be described in detail for specific preferred embodiments of the invention, it being understood that these embodiments are intended only as illustrative examples and the invention is not to be limited thereto.

Methods and systems are provided for treating organic waste with mineral by-products. The methods and systems of the present invention are methods of stabilizing organic waste so as to control the tendency of the organic waste to ignite, where prior methods of treating organic waste have not yielded a consistent and reliable method of controlling the ignition of organic waste or organic waste solids resulting therefrom. The addition of determined amounts of mineral by-products to organic waste changes the physical and chemical characteristics of the mixture and significantly reduces the problems of the prior art, which does not consistently and predictably produce organic waste solids having reduced ignitability. The addition of mineral by-products to organic waste according to the methods of the present invention reduces the need to reheat treated organic waste and reduces the potential for fires and explosions when treated organic waste is stored and/or reheated.

The treatment methods of the present invention are also applicable to the drying of organic waste for purposes of physical stabilization of organic waste, which includes controlling ignitability, odor control, ease of handling and ease of storage, for purposes of disinfection, which includes destruction of pathogens in those waste that contain pathogens, such as, sewage sludges and animal manures, and for the controlled burning of organic waste as fuel for power generation.

Non-limiting examples of organic waste that may be used in conjunction with the present invention may include one or more of the following wastes: sewage sludges, biosolids (which include stabilized sewage sludge), animal manures, pulp and paper sludges, food processing waste, waste paper and cardboard, and other industrial organic waste, such as fermentation biomass and pharmaceutical waste.

One or more mineral by-products are used in accordance with the present invention. According to one embodiment, the one or more mineral by-products include at least two mineral by-products.

Non-limiting examples of mineral by-products that may be used in conjunction with the present invention may include one or more of the following by-products: coal combustion by-products, wood ash, cement kiln dust, lime kiln dust, gypsum, mineral and rock fines. When the organic waste solids produced by the present invention are to be burned, for example in a coal burning power plant, non-limiting examples of preferred mineral by-products include lime, quicklime, diatomaceous earth and limestone.

Coal combustion by-products include for example, fly ash. Fly ashes have variable fineness, solids content, and chemical composition. Fly ash is generally obtained from the combustion products of pulverized coal, usually by electrostatic precipitation. The chemical composition of ash depends on the type of coal that is burned. Typically, fly ash is made up of silica, alumina, iron oxide, calcium oxide, sulfur oxide and other trace materials. Coals from the western U.S. are typically high in calcium and thus, may contain a higher lime content than coals from the eastern U.S. Eastern coals are often higher in pyrite ($FeS_2$), which oxidizes on burning to $SO_2$, producing an acidic fly ash. Fly ashes are high in silicon, and are often in the form of a spherical glass. Some fly ashes are high in residual carbon in the form of charcoal and these are effective in absorbing biosolids odors.

Wood ash results when wood is burned for example, as a fuel for steam and power production. The ash is a combination of mineral residue and charcoal. Wood ash is a combination of mineral residue and charcoal. Wood ash has acid to alkaline pHs, and is very high in potassium. It does not contain significant CaO, but can produce heat when wetted. Most wood ash is handled as a slurry, but dry ash is available.

Cement kiln dust is wasted in cement manufacture because soluble sodium and potassium salts in the cement kiln dust lower cement quality. Cement kiln dust is fine-grained, has high surface area, and is extremely dry. The composition is a function of the limestone and clay that are mixed and fired in a kiln to produce cement. Limestone can be primarily calcite ($CaCO_3$) or dolomite ($CaMg(CO_3)_2$), while clay can contain iron and aluminum oxides, silica ($SiO_2$), or kaolinite, mica, vermiculite or montmorillonite. Part of the limestone is calcined to form CaO and MgO, so that cement kiln dust contains a mixture of calcium and magnesium oxides and carbonates.

Lime kiln dust is a by-product of lime (CaO or MgO) production by the calcining of calcitic or dolomitic limestone. Lime kiln dust has physical properties similar to those of cement kiln dust and usually contains more lime than cement kiln dust.

Gypsum is a natural mineral that may used as a soil additive and in the manufacture of wall board. Synthetic gypsum, anhydrite ($CaSO_4$), and $CaSO_3$ have similar characteristics and are formed from the chemical reaction of $SO_2$ with lime in the flue of coal-fired power plants. Synthetic gypsum is used primarily for wall board manufacture.

Lime, also known as quicklime has the chemical composition CaO and is formed from the high-temperature calcining of limestone. Lime has a myriad of commercial uses that are based on the production of heat when lime reacts with water, and on the high pH (~12.5) of lime. Limestone, in the form of calcite or dolomite, is one of the most abundant minerals in the earth's crust. It is widely used in agriculture to neutralize soil acidity, it is a precursor to lime production, and is used in cement manufacture.

Diatomaceous earth is composed of natural deposits of decomposed diatoms, which are a form of algae, which have a silica skeleton. The siliceous remains are structurally stable and microporous. The microporous nature of diatomaceous earth lends itself to use of this material as a filter in water treatment, e.g., in swimming pools.

Mineral and rock fines is a general term relating to fine-grained residual materials from rock crushing and screening. These materials are often so fine-grained as to be too difficult to use in commercial applications and become waste products to be disposed. Examples of rock fines include those from limestone, feldspar, sand, gravel, granite and marble quarries.

Mineral by-products provide odor control, improve the products' physical characteristics and supply additional trace nutrients to the end product. The mineral by-products of the present invention are preferably fine-grained, high surface area mineral by-products. Batch testing in a laboratory furnace is used to determine the by-product dose for a particular organic waste in a particular drying or fuel burning application.

The methods of the present invention first require determining the ignition threshold temperature for the organic waste and at least one mineral by-product. The ignition threshold temperature is determined by plotting the ignition temperature of a mixture of a sample of the organic waste with a sample of the mineral by-products to be added to the organic waste. The plot indicates a threshold dose rate of mineral by-product to inhibit spontaneous ignition of the organic waste.

FIG. 1 is a theoretical example of a plot of ignition temperature (° C.) of a mixture of an organic waste with a mineral by-product versus the dose rate of the mineral by-product (% by weight of the organic waste on a wet weight basis) added to the mixture. The curve in FIG. 1 shows that there is a relationship between the amount of mineral by-product added and the temperature at which the mixture ignites. The addition of increasing amounts of mineral by-product yields higher observed ignition temperatures. FIG. 1 also demonstrates a threshold dose rate of mineral by-product to inhibit spontaneous ignition of the organic waste. Beyond the threshold dose, additional amounts of mineral by-product are ineffective. The nature of the individual curve for a specific organic waste material is dependent on the nature of the organic waste (e.g., the content of fat, oil and grease lowers ignition temperatures) and on the physical and chemical characteristics of the mineral by-product(s) used. Therefore, a separate curve must be developed from laboratory testing for a given combination of organic waste and mineral by-product(s).

One method of arriving at a plot as in FIG. 1 to determine a threshold ignition temperature for a given organic waste sample and mineral by-product(s), includes performing the following laboratory test protocol steps: 1) small (preferably less than 100 g dry weight) samples of organic waste are mixed with increasing doses of a selected mineral by-product or a mixture of selected mineral by-products, the doses ranging from 0 to 100% of mineral by-products based on the wet weight of the organic waste on a wet weight basis in increments of 10%; (2) the mixtures are placed in a conventional muffle furnace modified so as to introduce an air stream into the oven and with a mirror mounted on the outlet aperture of the oven so as to observe ignition; (3) the temperature control on the oven is set to increase at a constant interval; and (4) the ignition temperature for each dose rate is recorded and the data is plotted as in FIG. 1 to determine the threshold ignition temperature for the particular waste and mineral by-product.

Figure 2:
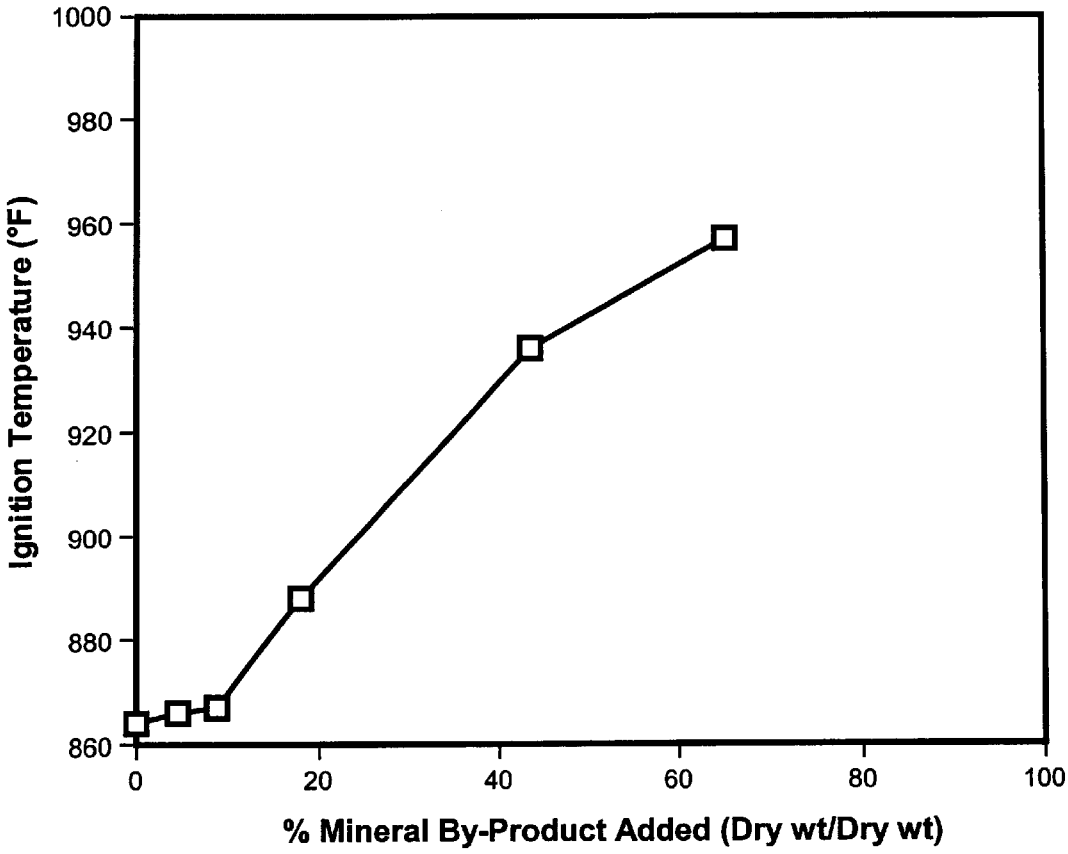
FIG. 2 is a plot of ignition temperature (° F.) of a sample of organic waste, in particular biosolids, with a mineral by-product versus the dose rate of mineral by-product (% by weight of the biosolids on a dry weight basis).

A specific example of a method of plotting ignition temperature versus percent mineral by-product added is set forth in Example 1 below and is depicted in FIG. 2.

Other methods of determining a threshold ignition temperature may be used, based on the above description. For example, the dose increments may be varied, the furnace type may be varied, and other features of the experiment may be varied and still fall within the method of the present invention.

Based on the ignition threshold temperature determined from the plot for given organic waste and mineral by-product(s), a ratio of organic waste:mineral by-product(s) for the actual (larger scale) process is selected and the one or more mineral by-products are then combined with the organic waste so as to arrive at a mixture having the selected ratio of organic waste:mineral by-product(s).

The combining step preferably involves intimate mixing of prescribed amounts of organic waste and mineral by-product(s) in a mixer or blender. The mixer or blender is preferably a mixer or blender that thoroughly mixes the organic waste with the mineral by-product(s) until the mix is substantially homogeneous throughout the mass. Suitable mixers or blenders for this purpose would be known to those skilled in the art having read the present disclosure.

The process of the present invention then includes drying (or first storing and then drying) the organic waste-coal combustion by-product mixture to at least 60%, preferably at least about 90% solids, more preferably at least 95% solids, most preferably as near 100% solids as possible. The mixture so-dried is referred to herein as "organic waste solids". The organic waste solids of the present invention may include mineral by-products from the mixture prior to drying.

Organic waste is generally in the form of a moist feed that may, as a practical matter include from about 5% by weight to about 50% or more of solids. Depending on the organic waste being treated and the amount and type of moist feed and the degree of solids therein, multiple drying steps may be required in order to produce organic waste solids in accordance with the methods of the present invention, including the drying methods set forth below. Drying steps may take place before the organic waste solids are combined with the one or more mineral by-products, as well as taking place after such combination.

The drying of a moist feed or organic waste, may be accomplished in a number of different ways by different types of devices. One such device is a pug mill; another is a rotating drum; a third is a simple covered mixing tank provided with stirring or agitating means. A fluidized bed is another example of an apparatus that may be used to dry the moist feed.

Additionally, commercial dryers, may be used alone or in combination with the pug mill or other drying methods, to dry the organic waste, or mixture of organic waste and mineral by-products. Such commercial dryers are available in two forms, direct and indirect. A dryer according to the present invention may include one or more direct dryers or indirect dryers.

Direct dryers use heated air in direct contact with the organic waste. According to one embodiment of the present invention, exhaust stack gases from a power plant for example, may be used directly or waste steam or hot water from the power plant may be used with a heat exchanger to heat air for drying.

Alternatively, indirect dryers may be used, which heat metal surfaces that come in contact with the organic waste. In one example of this embodiment, waste steam or hot water from the power plant may be used to heat the drying surfaces via a heat exchanger in which the waste steam or water is used to heat oil, the fluid normally used in indirect dryers.

Non-limiting examples of suitable dryers according to the present invention include direct concurrent flow dryers, direct rotary dryers, concurrent forced air rotary dryers, horizontal single, double and triple pass indirect dryers, and vertical counter flow rotating disk indirect dryers.

Heat for drying the mixture may alternatively, or additionally come from a source other than a power plant, such as a steam turbine or other sources known to those skilled in the art.

The methods of the present invention may also include burning the organic waste solids, for example in combination with coal in a coal burning power plant as described in further detail in a U.S. Patent Application filed on Apr. 20 2001 entitled "Processes and Systems for Using Biomineral By-Products as a Fuel and for $NO_x$ Removal at Coal Burning Power Plants", which is hereby incorporated by reference herein in its entirety.

The present invention also provides organic waste solids formed by the methods described herein, which are advantageous over prior organic waste solids in that they do not have a tendency to ignite. The organic waste solids may be useful for example as a fuel source for example, to a coal burning power plant. The stabilized organic waste formed by the methods described herein may also be used as soil additives.

The present invention further provides a system for treating organic waste, which includes means for determining an ignition threshold temperature for organic waste and the one or more mineral by-products, means for combining the one or more mineral by-products with the organic waste, so as to arrive at a mixture having a selected ratio of organic waste:mineral by-product(s) based on the ignition threshold temperature, and drying means for drying the mixture of organic waste and mineral by-product to produce organic waste solids. In this embodiment, the mineral by-product(s), organic waste, organic waste solids, and other features are as described above with regard to the methods of the present invention.

In this embodiment, the means for determining an ignition threshold temperature for organic waste includes, for example the method described above, which includes plotting the ignition temperature of a mixture of a sample of the organic waste to be treated with a sample of the mineral by-product(s) to be added to the organic waste.

The means for combining the one or more mineral by-products with organic waste may include for example providing a mixer or blender as described in further detail with respect to the methods described above.

The drying means of this embodiment may include for example, a pug mill or other non "dryer" apparatus described above, and/or one or more dryers described above and known to those skilled in the art, based on various factors including for example, the composition being dried, the amount of the composition being dried, and the extent to which it must be dried.

The present invention will now be described in detail with respect to showing how certain specific representative embodiments thereof can be made, the materials, apparatus and process steps being understood as examples that are intended to be illustrative only. In particular, the invention is not intended to be limited to the methods, materials, conditions, process parameters, apparatus and the like specifically recited herein.

EXAMPLES

Example 1

A laboratory test protocol for creating a plot, from which to determine threshold ignition temperature includes the following steps: 1) adding various amounts of fly ash to an anaerobically digested biosolids product, 2) drying the mixtures to approximately 60% solids, and 3) placing small (2 g) samples of the mixtures on a stainless steel screen in a conventional muffle furnace (modified so as to introduce an air stream into the oven and with a mirror mounted near the outlet aperture of the oven so as to observe ignition) equilibrated to specific temperature. The samples are then observed for a 5-minute interval for ignition (appearance of a flame). The temperature that each mixture ignited is recorded and the data plotted as in FIG. 2 to reflect the threshold ignition temperature for each biosolids/fly ash mixture.

Example 2

A direct rotary dryer is used to dry dewatered sewage sludge filter cake (20% solids). Samples of the sludge are mixed with coal fly ash and the ignition threshold temperature is determined using the protocol previously described. The ignition threshold temperature dose rate is used to determine the sludge: fly ash mixing ratio. The sludge filter cake and a predetermined amount of fly ash are mixed in a pug mill and discharged into a concurrent forced air rotary dryer. The mixture is dried to >95% solids to meet U.S. EPA requirements for Class A pathogen reduction and vector attraction reduction (VAR).

Example 3

Waste heat from a coal burning power plant is used to dry chicken manure in an indirect dryer. Coal fly ash from the power plant is mixed with the chicken manure to control ignition during drying. Samples of the chicken manure (60% solids) are mixed with coal fly ash and the ignition threshold temperature is determined using the protocol previously described. The ignition threshold temperature dose rate is used to determine the sludge: fly ash mixing ratio. The chicken manure and fly ash are mixed in a pug mill and discharged into a counter-current, indirect dryer using waste steam or hot water from the power plant as a heat source. The mixture is dried to close to 100% solids and is mixed with pulverized coal as a supplemental fuel.

Example 4

This example demonstrates the instability of sludge resulting from drying by methods known in the art without using the methods of the present invention.

A direct rotary dryer is used to dry dewatered sewage sludge filter cake (20% solids). The sludge filter cake and a pre-determined amount of fly ash are mixed in a pug mill and discharged into a concurrent forced air rotary dryer. The mixture is dried to >95% solids to meet U.S. EPA requirements for Class A pathogen reduction and vector attraction reduction (VAR). The dried material is then conveyed and stored in an enclosed silo or other enclosed structure in which the combination of dried organic dusts and volatiles and heat may cause spontaneous combustion.

In this example, in which the ignition threshold temperature was not determined and the relevant sludge: fly ash mixing ratio determined, the drying may produce unstable dried sludge, which may spontaneously combust.

The method of the present invention has several advantages over previous techniques for treating organic waste. In particular, the present method produces more stable organic waste than the prior methods, which stable organic waste does not ignite.

While the present invention is described with respect to particular examples and preferred embodiments, it is understood that the present invention is not limited to these examples and embodiments. In particular, the present invention is not limited to use with particular organic waste or particular mineral by-products. Moreover, the present invention is not limited to use with the particular exemplified dryers or drying conditions, so long as the drying takes place at a temperature lower than the ignition temperature of the organic waste depending on the percentage of mineral by-product added to the organic waste. Additionally, further ingredients may be added to the mixture of organic waste and mineral by-products depending on the desired use for the resulting organic waste solids, as long as the further ingredients are also accounted for in the determination of the ignition threshold temperature.

The present invention as claimed therefore, includes variations from the particular examples and preferred embodiments described herein, as will be apparent to one of skill in the art.

We claim:

1. A method of treating organic waste comprising determining an ignition threshold temperature for organic waste and at least one mineral by-product selected from the group consisting of coal combustion by-products, wood ash, cement kiln dust, lime kiln dust, gypsum, mineral and rock fines;

selecting a ratio of organic waste:mineral by-product based on the ignition threshold temperature;

combining the at least one mineral by-product with the organic waste, so as to arrive at a mixture having the selected ratio of organic waste:mineral by-product; and drying the mixture of organic waste and mineral by-product to produce organic waste solids.

2. The method of claim 1, wherein the organic waste comprises waste selected from the group consisting of sewage sludges, animal manures, biosolids, pulp and paper sludges, food processing waste, waste paper and cardboard, and other industrial organic waste.

3. The method of claim 1, wherein the at least one mineral by-product comprises at least two mineral by-products.

4. The method of claim 1, wherein said drying is conducted by direct or indirect dryers.

5. The method of claim 1, further comprising burning said organic waste solids.

6. The method of claim 5, wherein said at least one mineral by-product comprises at least one mineral by-product selected from the group consisting of lime, quicklime, diatomaceous earth and limestone.

7. Organic waste solids formed by a method comprising determining an ignition threshold temperature for organic waste and at least one mineral by-product selected from the group consisting of coal combustion by-products, wood ash, cement kiln dust, lime kiln dust, gypsum, mineral and rock fines;

selecting a ratio of organic waste:mineral by-product based on the ignition threshold temperature;

combining the at least one mineral by-product with the organic waste, so as to arrive at a mixture having the selected ratio of organic waste:mineral by-product; and drying the mixture of organic waste and mineral by-product to produce organic waste solids.

8. A method of stabilizing organic waste comprising determining an ignition threshold temperature for organic waste and at least one mineral by-product selected from the group consisting of coal combustion by-products, wood ash, cement kiln dust, lime kiln dust, gypsum, mineral and rock fines;

selecting a ratio of organic waste:mineral by-product based on the ignition threshold temperature;

combining the at least one mineral by-product with the organic waste, so as to arrive at a mixture having the selected ratio of organic waste:mineral by-product; and drying the mixture of organic waste and mineral by-product to produce organic waste solids.

9. A method of controlling ignitability of organic waste comprising determining an ignition threshold temperature for organic waste and at least one mineral by-product selected from the group consisting of coal combustion by-products, wood ash, cement kiln dust, lime kiln dust, gypsum, mineral and rock fines;

selecting a ratio of organic waste:mineral by-product based on the ignition threshold temperature;

combining the at least one mineral by-product with the organic waste, so as to arrive at a mixture having the selected ratio of organic waste:mineral by-product; and drying the mixture of organic waste and mineral by-product to produce organic waste solids.

10. A method of treating organic waste comprising determining an ignition threshold temperature for organic waste and at least one mineral by-product selected from the group consisting of coal combustion by-products, wood ash, cement kiln dust, lime kiln dust, gypsum, mineral and rock fines;

selecting a ratio of organic waste:mineral by-product based on the ignition threshold temperature;

combining the at least one mineral by-product with the organic waste, so as to arrive at a mixture having the selected ratio of organic waste:mineral by-product;

drying the mixture of organic waste and mineral by-product to produce organic waste solids; and storing the mixture of organic waste and mineral by-product.

11. The method of claim 10, wherein the organic waste comprises waste selected from the group consisting of sewage sludges, animal manures, biosolids, pulp and paper sludges, food processing waste, waste paper and cardboard, and other industrial organic waste.

12. The method of claim 10, wherein the at least one mineral by-product comprises at least two mineral by-products.

13. The method of claim 10, wherein said drying is conducted by direct or indirect dryers.

14. The method of claim 10, further comprising burning said organic waste solids after storing.

15. The method of claim 14, wherein said at least one mineral by-product comprises at least one mineral by-product selected from the group consisting of lime, quicklime, diatomaceous earth and limestone.

16. Organic waste solids formed by a method comprising determining an ignition threshold temperature for organic waste and at least one mineral by-product selected from the group consisting of coal combustion by-products, wood ash, cement kiln dust, lime kiln dust, gypsum, mineral and rock fines;

selecting a ratio of organic waste:mineral by-product based on the ignition threshold temperature;

combining the at least one mineral by-product with the organic waste, so as to arrive at a mixture having the selected ratio of organic waste:mineral by-product;

drying the mixture of organic waste and mineral by-product to produce organic waste solids; and storing the mixture of organic waste and mineral by-product.

* * * * *

UNITED STATES PATENT AND TRADEMARK OFFICE

CERTIFICATE OF CORRECTION

PATENT NO. : 6,666,154 B2
DATED : December 23, 2003
INVENTOR(S) : Terry J. Logan et al.

It is certified that error appears in the above-identified patent and that said Letters Patent is hereby corrected as shown below:

Column 3,
Line 37, please change to read as follows:
-- Gypsum is a natural mineral that may be used as a soil --

Column 6,
Lines 4-7, please change to read as follows:
-- further detail in U.S. Patent No. 6,405,664, orginally filed on April 23, 2001, entitled "Processes and Systems for Using Biomineral By-Products as a Fuel and For $NO_x$ Removal at Coal Burning Power Plants,", which is hereby incorporated by reference herein it its entirety. --

Signed and Sealed this

Twenty-eighth Day of June, 2005

JON W. DUDAS
*Director of the United States Patent and Trademark Office*